United States Patent [19]

Wardell

[11] 4,294,186

[45] Oct. 13, 1981

[54] RETRACTABLE BOW THRUSTER

[76] Inventor: Gerald S. Wardell, 2249 SW. 68th Ter., Miramar, Fla. 33023

[21] Appl. No.: 117,219

[22] Filed: Jan. 25, 1980

[51] Int. Cl.[3] ..... B63H 25/42

[52] U.S. Cl. ..... 114/151; 440/53

[58] Field of Search ..... 114/151; 440/53-54, 440/58

[56] References Cited

U.S. PATENT DOCUMENTS

| | | | |
|---|---|---|---|
| 3,487,805 | 1/1970 | Satterthwaite et al. | 114/151 X |
| 3,550,547 | 12/1970 | Pleuger et al. | 114/151 |
| 3,587,512 | 6/1971 | Patterson | 440/54 |

FOREIGN PATENT DOCUMENTS

| | | | |
|---|---|---|---|
| 638507 | 12/1978 | U.S.S.R. | 114/151 |

*Primary Examiner*—Kathleen J. Prunner

*Attorney, Agent, or Firm*—Harvey B. Jacobson

[57] ABSTRACT

The device comprises a main support housing which is secured to the hull of a vessel. An opening is made within the lower portion of the housing through the vessel hull to allow a thruster drive assembly to lower into operative position. The drive assembly includes an upper gear housing which mounts a drive gear. The upper gear housing is pivotally mounted for rotation about the axis of rotation of the drive gear. The opposite end of the upper gear housing is pivotally attached to a vertically displaceable lower gear housing which mounts an idler gear and a propeller. The idler gear drives a ring gear disposed about the propeller. When the upper gear housing is moved about its pivot axis, the lower gear housing moves vertically causing the propeller to move from a recessed position to an operative position below the bow of the boat to provide lateral thrust to the boat.

14 Claims, 5 Drawing Figures

2
2

RETRACTABLE BOW THRUSTER

BACKGROUND OF THE INVENTION

1. Field of the Invention

This invention relates to navigation equipment and especially to steering mechanisms for ships in the form of lateral thrusters.

2. Discussion of Related Art

Certain vessels, principally house boats and boats with a shallow draft, are designed with hull configurations that are greatly affected by wind and currents in maneuvering. Such vessels are usually built with high cabins and control stations forward of the vessel. The shallowness of the hull designs coupled with the high structures on deck make the vessels extremely vulnerable to the effects of wind and currents and, therefore, difficult to control.

In attempting to control such vessels, it is known to apply lateral thrust by means of a propeller having a transverse axis of rotation. One example of such a lateral thruster is the device shown in U.S. Pat. No. 2,699,138, issued Jan. 11, 1955, to Dyer. The Dyer invention includes a bow steering unit having a lateral thruster propeller. The unit is carried by a vertically moving housing which is disposed in a well extending from the deck of the vessel to the bottom. U.S. Pat. No. 3,759,211, issued Sept. 18, 1973, to Kuntz, shows a controllable pitch tunnel thruster which comprises a tunnel formed transversely of the bow of the ship to be controlled. A propeller is disposed within the tunnel and driven through a ring gear attached about the periphery of the propeller.

No thruster is known which can be conveniently attached to a shallow draft vessel for improving the maneuverability of the vessel without taking up considerable room.

SUMMARY OF THE INVENTION

One object of the present invention is to provide a retractable bow thruster which is adapted for use on shallow draft vessels.

A further object of the present invention is to provide a retractable bow thruster which is economical to build yet rugged and effective in operation.

Yet a still further object of the present invention is to provide a retractable bow thruster which can be positioned on the vessel such as to avoid being subject to cavitation and hull turbulence.

An even still further object of the present invention is to provide a retractable bow thruster which can be retracted through simple controls to a fully retracted position in order to avoid interference with hull movement through the water at higher speeds and be protected from any damage while the vessel is underway.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
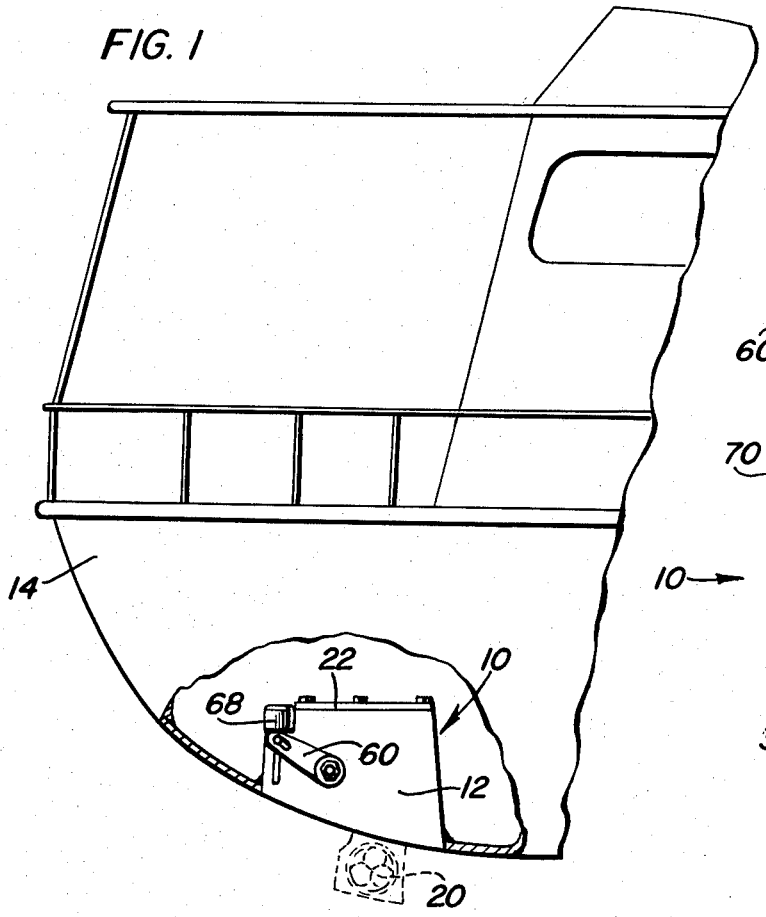
FIG. 1 is a side elevational fragmental view of a vessel equipped with the retractable bow thruster.

Now with reference to the drawings, a retractable bow thruster incorporating the principles and concepts of the present invention and generally referred to by the reference numeral 10 will be described in detail. Thruster 10 includes a main support housing 12 which is secured onto the hull of a ship 14 by bonding, welding, fastening, or any other suitable means. An opening 16 is formed in the lower portion of housing 12 and is positioned over a similar sized opening in the hull of ship 14 in order to allow the thruster drive assembly 18 to lower drive propeller 20 to a position projecting from the hull of ship 14 below the waterline in order to provide transverse thrust to the bow of the ship 14. The housing 12 includes a removable cover 22 which is bolted in place through use of bolts 24 or any other suitable securing mechanism. Accordingly, cover 22 can easily be removed in order to service or replace portions of the thruster drive assembly 18.

The thruster drive assembly 18 consists of an upper gear housing 26 and a lower gear housing 28. Upper gear housing 26 contains drive gear 30 which meshes with and drives idler gear 32 located within the upper portion of lower housing 28. A pivot and gear bearing shaft 34 extends through the upper housing 26, the upper portion of lower housing 28 and idler gear 32. In this manner, gear 32 can rotate within housing 28 while housing 26 and housing 28 can pivot with respect to each other. Idler gear 32 meshes with ring gear 36 which is bonded to an external cylindrical flange 39 surrounding propeller 20. Accordingly, drive gear 30 causes rotation of propeller 20 through idler gear 32 and ring gear 36. At the same time, upper housing 26 is allowed to pivot about the axis of rotation of gear 30. When upper housing 26 pivots, the lower housing 28 is driven upwardly through opening 16 into a recessed position shown at 28' within the confines of the housing 12.

Drive gear 30 is driven by motor 38 mounted externally of the housing 12. Motor shaft 40 is engaged within spline 42 from which a reduced shaft 44 extends. Spline 42 meshes with inner splined surface 46 of gear 30 to impart motion to that gear. The reduced shaft 44 is mounted within an auxiliary control shaft 48 which has an opening to receive shaft 44 in one side. The opening of shaft 48 has a bearing surface disposed therein to support shaft 44 while motor shaft 40 is turning. A squared end 50 is received within squared opening 52 formed in upper housing 26 such that housing 26 and auxiliary control shaft 48 move in unison. The squared end 50 extends out of housing 12 and is covered by bushing 56. A control arm 58 contains a squared opening 60 which receives the extreme end of squared end 50 such that control arm 58 controls pivotal movement of housing 26 through the auxiliary control shaft 48. The opposite end of control arm 58 contains an enlarged slot 62 which receives a threaded pivot rod 64, the movement of which controls motion of the arm 58. Threaded pivot rod 64 moves vertically along threaded shaft 66 when that shaft is rotated by electric motor 68.

Accordingly, when motor 68 is rotated in a first direction, the pivot rod 64 progresses downwardly on shaft 66 causing upper housing 26 to pivot on reduced shaft 44 of spline 42. This in turn causes the lower housing 28 to move upwardly into position 28' shown in FIG. 4. Opposite rotation of the motor 68 causes pivot rod 64 to rise on shaft 66 which results in lower housing 28 moving outwardly from main housing 12 into its operative position.

Figure 2:
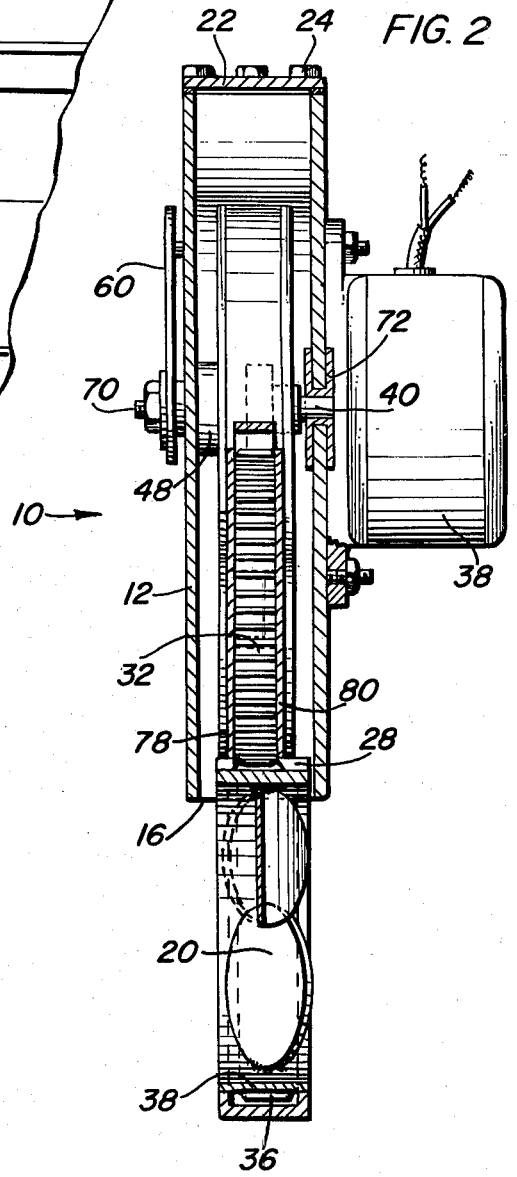
FIG. 2 is an end elevational sectional view of the retractable bow thruster.
Figure 3:
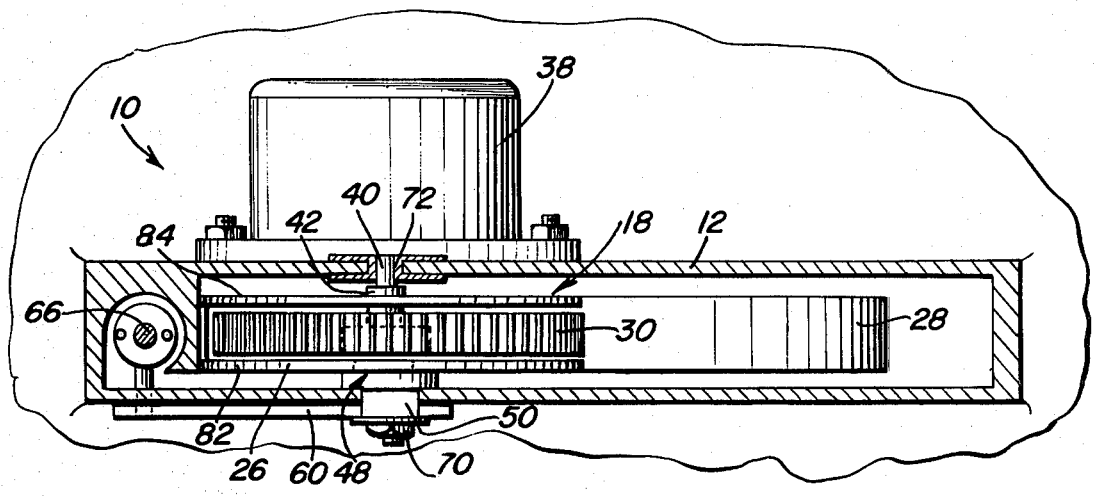
FIG. 3 is a top plan sectional view of the retractable bow thruster.

Obviously, other minor elements are used to maintain the thruster drive assembly 18 in operative condition within housing 12. For instance, nut 70 is placed on the outer threaded end of auxiliary control shaft 48 in order to maintain control arm 58 in position thereon. Further, a shaft support flange 72 shown in FIGS. 2 and 3 is positioned within housing 12 and allows motor shaft 40 to pass therethrough. Flange 72 both supports and journals shaft 40 when that shaft is rotating and provides a pivotal point for upper housing 26 to rotate on.

Figures 4, 5:
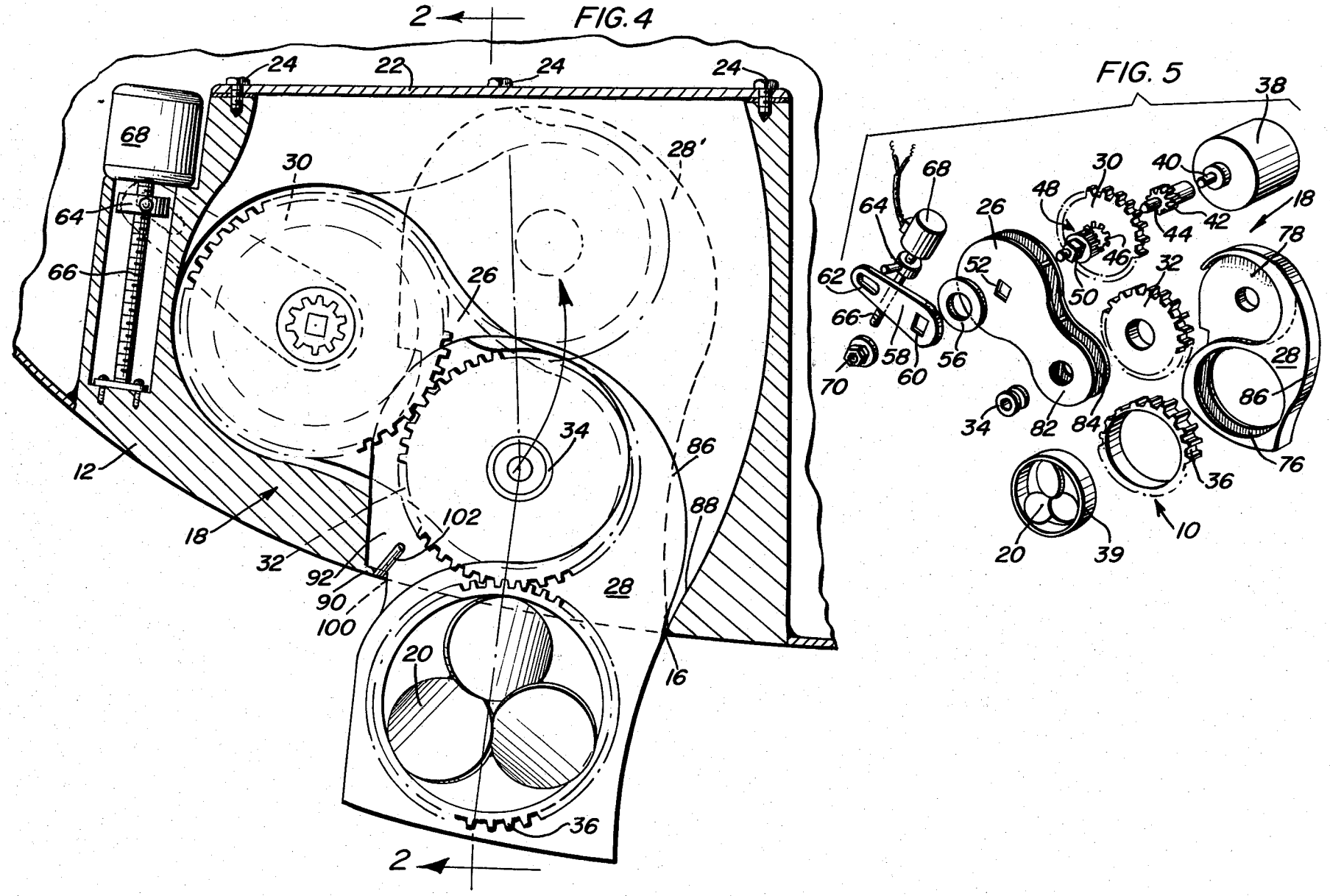
FIG. 4 is a side elevational sectional view of the retractable bow thruster.
FIG. 5 is an exploded view of the essential elements of the drive mechanism of the retractable bow thruster.

The lower housing 28 is a hollow shell having a lower opening 76 which receives the ring gear 36 and the propeller 20. The upper portion of the housing receives gear 32 between recessed walls 78 and 80. The upper housing 26 contains two parallel walls 82 and 84 which are disposed on opposite sides of the recessed walls 78 and 80 of the lower housing and slide thereagainst during relative pivotal motion of the upper and lower housings. Lower housing 28 also includes an curved portion 86 which abuts against inwardly curved portion 88 of the main housing 12, as shown in FIG. 4, to act as a guide for the lower portion as it is lowered from its recessed position 28' to its operative position. A rearwardly extending lip 90 is formed on main housing 12 to cooperate with a projection 92 formed on the forward portion of lower housing 28. Lip 90 and projection 92 cooperate to provide a firm seating of the lower housing 28 and main housing 12 when the lower housing is in its operative position. Further, a pin 102, also shown in FIG. 4, projects upwardly and rearwardly from lip 90 to be received within a cooperating aperture 100 formed in projection 92 of lower housing 28. Thus, the lower housing is firmly held within main housing 12 when in its operative position and can provide sufficient lateral thrust to steer ship 14 without causing damage to any of the housing portions of the invention.

Another feature of the invention can be seen with respect to FIG. 2. The lower housing 28 is made of "Delrin" and thus can act as a bearing surface for the propeller 20 and annular flange 39 which mounts ring gear 36. The ends of ring gear 36 are recessed within the ends of the flange 39 thus, the outer portions of flange 39 ride directly on the walls of housing 28 which act as a bearing surface for the propeller. In this manner, the bearing of the propeller 20 is lubricated by sea water and is inexpensive to manufacture.

The total operation of the retractable bow thruster 10 should be apparent from the foregoing description. However, a concise explanation of such operation will now be set forth. Housing 12 is mounted within the vessel 14 relatively far forward of the vessel. Such mounting can be accomplished due to the fact that the unique up and down movement of the propeller 20 not only reduces the size of the device 10, but also allows the propeller to be completely recessed within the housing during periods of non-use. Also, since the unit is mounted further forward than would otherwise be allowable, the power of drive motor 38 can be less than would otherwise be necessary since less thrust is needed in such a forward position.

Obviously, when the lateral thrust produced by thruster 10 is not needed, electric motor 68 is energized causing the threaded pivot rod 64 to ride downwardly on threaded shaft 66. This causes upper housing 26 to pivot upwardly on the axis of rotation of gear 30. Upward pivotal movement of housing 26 causes lower housing 28 to move upwardly within the main housing 12 thereby drawing the propeller 20 totally within the confines of the lower housing. When lateral thrust is needed, opposite energization of electric motor 68 is effected causing upward movement of threaded pivot rod 64 on threaded shaft 66 thereby downwardly pivoting upper housing 26 and forcing lower housing 28 to slide down with the main housing 12. The rear curved portion 86 guides the lower housing against surface 88 of the main housing 12 while pin 102 engages opening 100 guiding lower housing 28 into its rest position with projection 92 set against lip 90. At this time, the thruster is ready for operation and the motor 38 can be energized in either a forward or reverse direction to provide thrust in either a port or starboard direction for the vessel 14.

It should be noted that the thruster drive system 18 does not need a deep "Vee" in the bow for its operation as it drives beneath the hull at the curvature of the bow. It is thus very economical to build, in that it has no gear boxes for direction changes to transmit its power or to reverse such transmission. The reversible DC motor 38 accomplishes this reversing effect. Also, since the drive source for both motors of the system is electrical, the power is derived from the main drive electrical system, thus reducing the cost of the thruster 10. Further, since the retractable thruster 10 drives from beneath the vessel, it is actually not as deep in the water as the main propeller and so it can operate in less water. This actually allows the unit to operate in shallower water than other units and is ideal for rivers and bays.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A retractable thruster for use in providing lateral thrust for steering a vessel, comprising:

a main housing;

a first gear housing disposed within said main housing;

a drive gear mounted for rotation within said first gear housing, said first gear housing having mounting means for providing a pivotal connection to said main housing, said pivotal connection allowing said first gear housing to pivot about the axis of rotation of said drive gear;

a propeller;

drive means connected between said drive gear and said propeller for causing rotation of said propeller upon rotation of said drive gear; and connection means operatively connecting said propeller to said first gear housing for causing said propeller to move up and down within said housing upon pivotal movement of said first gear housing.

2. The invention as defined in claim 1 and further including motor means operatively connected to said drive gear for causing powered rotation thereof.

3. The invention as defined in claim 2 and further including second motor means operatively connected to said first gear housing for causing powered pivotal movement of said first gear housing.

4. The invention as defined in claim 3 and further including a bearing means for mounting said drive gear on said first gear housing, said bearing means including an extension projecting laterally of said housing and fixed with respect to said housing, a control arm fixedly mounted on said projection, pivotal movement of said control arm on said projection causing said pivotal movement of said upper housing.

5. The invention as defined in claim 4 wherein said second motor means includes an electric motor mounted for rotation with a threaded rod, said threaded rod having a follower mounted thereon, said follower being connected to said control arm for causing pivotal movement of said control arm upon rotation of said threaded rod.

6. The invention as defined in claim 1 and further including a second gear housing, said propeller being mounted for rotation within said second gear housing and said connection means including a pivotal connection formed between said first gear housing and said second gear housing.

7. The invention as defined in claim 6 wherein said drive means includes a ring gear mounted about the periphery of said propeller and an idler gear mounted between said drive gear and said ring gear for transmitting power from said drive gear to said ring gear.

8. The invention as defined in claim 7 and further including a shaft mounting said idler gear, said shaft extending through said first gear housing and said second gear housing for forming the pivotal connection between said first gear housing and said second gear housing.

9. In a ship, a thruster mounted in the hull of said ship, said thruster including a propeller having an axis of rotation transverse to the longitudinal extent of said ship;

drive means mounted for causing powered rotation of said propeller, said drive means including a drive gear and a motor having a shaft connected to said drive gear;

a main housing mounted in the hull of said ship, said main housing mounting said motor and said drive gear;

a first gear housing surrounding said drive gear and pivotally mounted in said main housing;

a second gear housing connected to said first gear housing, said propeller being mounted in said second gear housing; and guide means formed in said main housing for guiding said second gear housing from an inoperative position retracted within said main housing to an operative position with said propeller projecting outwardly of said main housing upon pivotal movement of said first gear housing.

10. The invention as defined in claim 9 wherein said first gear housing pivots about said motor shaft.

11. The invention as defined in claim 10 and further including an idler gear disposed between said drive gear and said propeller, said second gear housing being pivotally connected to said first gear housing through the axis of rotation of said idler gear.

12. The invention as defined in claim 11 wherein said main housing includes a projecting pin, said second gear housing including a cooperating aperture for receiving said projecting pin when said second gear housing is in its operative position.

13. The invention as defined in claim 12 and further including a second motor means operatively connected to said first gear housing for causing rotation of said first gear housing.

14. The invention as defined in claim 13 wherein said second motor means includes a threaded shaft, a follower mounted on said threaded shaft and a control arm connected between said follower and said first gear housing.

* * * * *